US009212323B2

(12) United States Patent
Dindi et al.

(10) Patent No.: US 9,212,323 B2
(45) Date of Patent: Dec. 15, 2015

(54) LIQUID-FULL HYDROTREATING AND SELECTIVE RING OPENING PROCESSES

(71) Applicant: E I DU PONT DE NEMOURS AND COMPANY, Wilmington, DE (US)

(72) Inventors: Hasan Dindi, Wilmington, DE (US); Thanh Gia Ta, New Castle, DE (US)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 0 days.

(21) Appl. No.: 14/335,058

(22) Filed: Jul. 18, 2014

(65) Prior Publication Data

US 2014/0332443 A1 Nov. 13, 2014

Related U.S. Application Data

(63) Continuation-in-part of application No. 13/025,427, filed on Feb. 11, 2011.

(51) Int. Cl.

| | |
|---|---|
| ***C10G 45/02*** | (2006.01) |
| ***C10G 45/08*** | (2006.01) |
| ***C10G 45/22*** | (2006.01) |
| ***C10G 45/48*** | (2006.01) |
| ***C10G 45/58*** | (2006.01) |
| ***C10G 45/60*** | (2006.01) |
| ***C10G 65/08*** | (2006.01) |
| ***C10G 65/12*** | (2006.01) |
| ***C10G 69/02*** | (2006.01) |
| ***C10G 45/50*** | (2006.01) |
| ***C10G 45/54*** | (2006.01) |
| ***C10G 65/04*** | (2006.01) |

(52) U.S. Cl.

CPC ..... *C10G 45/02* (2013.01); *C10G 45/08* (2013.01); *C10G 45/22* (2013.01); *C10G 45/48* (2013.01); *C10G 45/50* (2013.01); *C10G 45/54* (2013.01); *C10G 45/58* (2013.01); *C10G 45/60* (2013.01); *C10G 65/043* (2013.01); *C10G 65/08* (2013.01); *C10G 65/12* (2013.01); *C10G 69/02* (2013.01); *C10G 2300/202* (2013.01); *C10G 2300/307* (2013.01); *C10G 2300/308* (2013.01); *C10G 2300/4018* (2013.01); *C10G 2300/4081* (2013.01); *C10G 2300/802* (2013.01); *C10G 2400/04* (2013.01)

(58) Field of Classification Search

CPC ..... C10G 45/02; C10G 45/54; C10G 45/50; C10G 65/043; C10G 45/48; C10G 65/08; C10G 45/22; C10G 45/08; C10G 65/12; C10G 69/02; C10G 45/60; C10G 45/58; C10G 2300/307; C10G 2300/308; C10G 2300/02

See application file for complete search history.

(56) References Cited

U.S. PATENT DOCUMENTS

| | | | |
|---|---|---|---|
| 7,569,136 | B2 | 8/2009 | Ackerson et al. |
| 7,794,585 | B2 | 9/2010 | Leonard et al. |

(Continued)

*Primary Examiner* — Randy Boyer
*Assistant Examiner* — Juan Valencia

(57) ABSTRACT

This disclosure relates to liquid-full processes for hydroprocessing a light cycle oil (LCO). The processes involve hydrotreatment followed by selective ring opening in the presence of hydrotreating catalyst and selective ring opening catalyst respectively. The selective ring opening catalyst can be either zeolite ring opening catalyst or amorphous ring opening catalyst. In aspects of zeolite ring opening catalyst, the volume ratio of the total amount of the zeolite ring opening catalyst to the total amount of the hydrotreating catalyst is from about 0.2 to about 1.5. In aspects of amorphous ring opening catalyst, the volume ratio of the total amount of the amorphous ring opening catalyst to the total amount of the hydrotreating catalyst is from about 0.2 to about 3.

25 Claims, 2 Drawing Sheets

(56) References Cited

U.S. PATENT DOCUMENTS

2009/0200202 A1* 8/2009 Grande et al. ..... 208/100
2009/0326289 A1* 12/2009 Petri et al. ..... 585/263
2012/0116134 A1* 5/2012 Bozzano et al. ..... 585/240
2012/0205285 A1 8/2012 Dindi et al.

* cited by examiner

LIQUID-FULL HYDROTREATING AND SELECTIVE RING OPENING PROCESSES

CROSS-REFERENCE TO RELATED APPLICATION

This application is a Continuation-in-Part of the U.S. patent application Ser. No. 13/025,427 filed Feb. 11, 2011.

BACKGROUND

1. Field of the Disclosure

The present disclosure relates to a liquid-full process for hydroprocessing a hydrocarbon feed in liquid-full reactors with a combination of hydrotreating and selective ring opening catalysts.

2. Description of Related Art

Global demand for diesel, particularly for ultra-low-sulfur-diesel (ULSD) has risen quickly with increased growth of transportation fuels and a decrease in the use of fuel oil. Regulations for transportation fuels have been established to substantially lower the sulfur levels in diesel fuels. There are other pending rules calling to reduce the sulfur content in off-road diesel as well. Thus, there is a growing need for hydrocarbon feeds to use as feedstocks for producing diesel, including ULSD.

A refinery produces a number of hydrocarbon products having different uses and different values. It is desired to reduce production of or upgrade lower value products to higher value products. Lower value products include cycle oils which have historically been used as blend-stock for fuel oil. However, such oils cannot be directly blended into today's diesel fuels because of their high sulfur content, high nitrogen content, high aromatics content (particularly high polyaromatics), high density, and low cetane value.

Hydroprocessing, such as hydrodesulfurization and hydrodenitrogenation, have been used to remove sulfur and nitrogen, respectively from hydrocarbon feeds. An alternative hydroprocessing operation is hydrocracking, which has been used to crack heavy hydrocarbons (high density) into lighter products (lower density) with hydrogen addition. If the nitrogen content is too high in the hydrocarbon mixture going into the hydrocracking process, the zeolitic hydrocracking catalyst may be poisoned. In addition, if the hydrocracking is too severe, significant amounts of naphtha and lighter hydrocarbons, which are considered as lower value products, may be produced.

Conventional three-phase hydroprocessing units used for hydrotreating and high pressure hydrocracking, commonly known as trickle bed reactors, require hydrogen from a vapor phase to be transferred into liquid phase where it is available to react with a hydrocarbon feed at the surface of the catalyst. These units are expensive, require large quantities of hydrogen, much of which must be recycled through expensive hydrogen compressors, and result in significant coke formation on the catalyst surface and catalyst deactivation.

Alternative hydroprocessing approaches include hydrotreating and hydrocracking in a once-through flow scheme as proposed by Thakkar et al. in "LCO Upgrading A Novel Approach for Greater Value and Improved Returns" AM, 05-53, NPRA, (2005). Thakkar et al. disclose upgrading a light cycle oil (LCO) into a mixture of liquefied petroleum gas (LPG), gasoline and diesel products. Thakkar et al. disclose producing a low sulfur content diesel (ULSD) product. However, Thakkar et al. use traditional trickle bed reactors, which require large quantities of hydrogen and large process equipment such as a large gas compressor for hydrogen gas circulation. Significant amounts of light gas and naphtha are produced in the disclosed hydrocracking process. The diesel product accounts for only about 50%, or less, of the total liquid product using LCO feed.

Kokayeff, in U.S. Pat. No. 7,794,585, discloses a process for hydrotreating and hydrocracking hydrocarbon feedstocks in a "substantially liquid phase", which is defined as the feed stream has a larger liquid phase than a gas phase. More specifically, hydrogen may be present in a gas phase up to 1000 percent of saturation. Kokayeff teaches such high amounts are needed so that as hydrogen is consumed, hydrogen is available from the gas phase. Thus, Kokayeff's reaction system is a trickle bed. Separation of gases occurs after hydrocracking and before recycling a portion of the liquid product. Thus, hydrogen gas is lost from the reactor effluent, which may be significant, as Kokayeff teaches adding hydrogen well above the hydrogen saturation limit of the liquid.

It is desirable to have a process for hydroprocessing hydrocarbon feeds in a smaller and simpler system without an added gas phase or gas separation that may result in loss of process hydrogen. It is also desirable to have a process for hydroprocessing hydrocarbon feeds to produce low sulfur diesel in good yield and achieving multiple desirable diesel properties such as low density and low poly-aromatic content and high cetane number. It is further desired to have a process to upgrade lower value refinery hydrocarbons to higher value products.

BRIEF SUMMARY OF THE DISCLOSURE

The present disclosure provides a liquid-full process for hydroprocessing a hydrocarbon feed. The process comprises: (a) contacting the hydrocarbon feed with (i) a diluent and (ii) hydrogen, to produce a feed/diluent/hydrogen mixture, wherein the hydrogen is dissolved in the mixture to provide a liquid feed, and wherein the hydrocarbon feed is a light cycle oil (LCO) having a polyaromatic content greater than 25% by weight, a nitrogen content greater than 300 parts per million by weight (wppm), and a density greater than 890 kg/m$^3$ at 15.6° C.; (b) contacting the feed/diluent/hydrogen mixture with a first catalyst in a first liquid-full reaction zone, to produce a first product effluent; (c) contacting the first product effluent with a second catalyst in a second liquid-full reaction zone, to produce a second product effluent; and (d) recycling a portion of the second product effluent as a recycle product stream for use in the diluent in step (a)(i) at a recycle ratio of from about 1 to about 10; wherein the first catalyst is a hydrotreating catalyst and the second catalyst is a zeolite ring opening catalyst, the total amount of hydrogen fed to the process is greater than 100 normal liters of hydrogen per liter of the hydrocarbon feed, and the volume ratio of the total amount of the second catalyst to the total amount of the first catalyst is from about 0.2 to about 1.5.

The present disclosure also provides another liquid-full process for hydroprocessing a hydrocarbon feed. The process comprises: (a) contacting the hydrocarbon feed with (i) a diluent and (ii) hydrogen, to produce a feed/diluent/hydrogen mixture, wherein the hydrogen is dissolved in the mixture to provide a liquid feed, and wherein the hydrocarbon feed is a light cycle oil (LCO) having a polyaromatic content greater than 25% by weight, a nitrogen content greater than 300 parts per million by weight (wppm), and a density greater than 890 kg/m$^3$ at 15.6° C.; (b) contacting the feed/diluent/hydrogen mixture with a first catalyst in a first liquid-full reaction zone, to produce a first product effluent; (c) contacting the first product effluent with a second catalyst in a second liquid-full reaction zone, to produce a second product effluent; and (d)

recycling a portion of the second product effluent as a recycle product stream for use in the diluent in step (a)(i) at a recycle ratio of from about 1 to about 10; wherein the first catalyst is a hydrotreating catalyst and the second catalyst is an amorphous ring opening catalyst, the total amount of hydrogen fed to the process is greater than 100 normal liters of hydrogen per liter of the hydrocarbon feed, and the volume ratio of the total amount of the second catalyst to the total amount of the first catalyst is from about 0.2 to about 3.0.

The processes of this disclosure advantageously convert LCO to a diesel-range product in high yield. There is little loss of hydrocarbon to lower value naphtha. The diesel thus made is of high quality and well suited for use in applications where physical property requirements are strict, such as transportation fuels.

BRIEF DESCRIPTION OF THE FIGURES

Embodiments are illustrated in the accompanying figures to improve understanding of concepts as presented herein.

Figure 1:
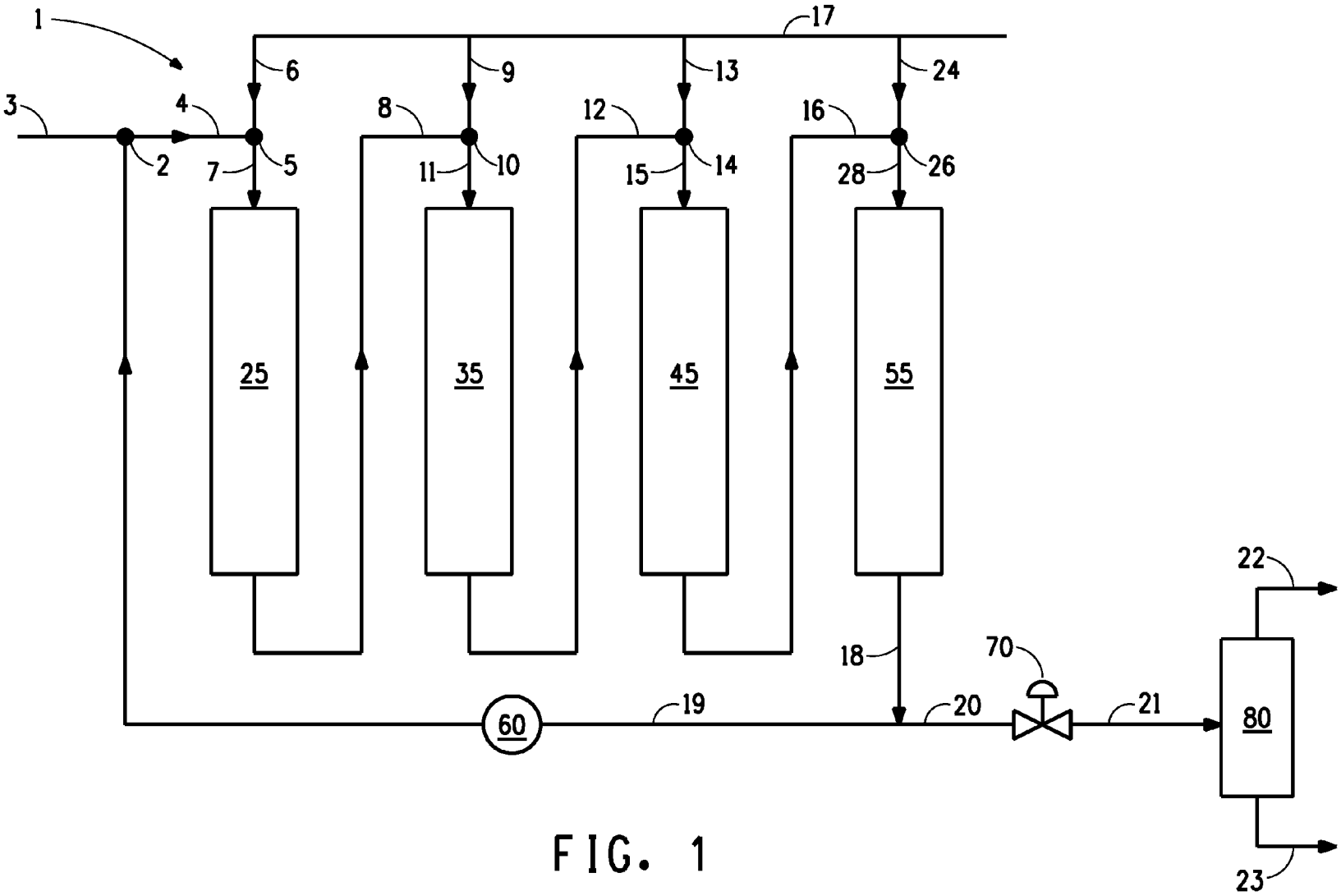
FIG. 1 shows one embodiment of the liquid-full hydroprocessing process of this disclosure.

Skilled artisans appreciate that objects in the figures are illustrated for simplicity and clarity and have not necessarily been drawn to scale. For example, the dimensions of some of the objects in the figures may be exaggerated relative to other objects to help to improve understanding of embodiments.

DETAILED DESCRIPTION

The foregoing general description and the following detailed description are exemplary and explanatory only and are not restrictive of the invention, as defined in the appended claims. Other features and benefits of any one or more of the embodiments will be apparent from the following detailed description, and from the claims.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Unless otherwise defined, all technical and scientific terms used herein have the same meaning as commonly understood by one of ordinary skill in the art to which this invention belongs. In case of conflict, the present specification, including definitions, will control. Although methods and materials similar or equivalent to those described herein can be used in the practice or testing of embodiments of the present invention, suitable methods and materials are described below. In addition, the materials, methods, and examples are illustrative only and not intended to be limiting.

When an amount, concentration, or other value or parameter is given as either a range, preferred range or a list of upper preferable values and/or lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range.

Before addressing details of embodiments described below, some terms are defined or clarified.

The term, "LHSV", as used herein, means liquid hourly space velocity, which is the volumetric rate of the hydrocarbon feed divided by the volume of the catalyst, and is given in $hr^{-1}$.

The term "an elevated temperature", as used herein, means a temperature higher than the room temperature.

The term "polyaromatic(s)", as used herein, means polycyclic aromatic hydrocarbons and includes molecules with nucleus of two or more fused aromatic ring such as, for example, naphthalene, anthracene, phenanthracene and so forth, and derivatives thereof.

The terms "diesel", "diesel product", and "diesel-range product", as used herein, are interchangeable and mean the distillate volume fraction from about 150° C. to about 380° C.

The term "second product effluent cetane increase", as used herein, means the increase of the cetane index value of the second product effluent compared to the cetane index value of the hydrocarbon feed.

The term "yield of the diesel-range product", as used herein, means the weight percentage of the diesel-range product compared to the total weight of naphtha and diesel-range product contained in the second product effluent.

The term "diesel product density reduction", as used herein, means the reduction of the density of the diesel-range product compared to the density of the hydrocarbon feed.

The term "diesel product cetane increase", as used herein, means the increase of the cetane index value of the diesel-range product compared to the cetane index value of the hydrocarbon feed.

The terms "naphtha" and "naphtha product", as used herein, are interchangeable and mean the distillate volume fraction from about 30° C. to about 150° C.

The term "naphtha yield", as used herein, means the weight percentage of the naphtha compared to the total weight of naphtha and diesel-range product contained in the second product effluent.

The term "hydroprocessing", as used herein, means a process that is carried out in the presence of hydrogen, including, but not limited to, hydrogenation, hydrotreating, hydrocracking, dewaxing, hydroisomerization, and hydrodearomatization.

The term "hydrotreating", as used herein, means a process in which a hydrocarbon feed reacts with hydrogen, in the presence of a hydrotreating catalyst, to hydrogenate olefins and/or aromatics or remove heteroatoms such as sulfur (hydrodesulfurization), nitrogen (hydrodenitrogenation, also referred to as hydrodenitrification), oxygen (hydrodeoxygenation), metals (hydrodemetallation), asphaltenes, and combinations thereof.

The term "hydrocracking", as used herein, means a process in which a hydrocarbon feed reacts with hydrogen, in the presence of a hydrocracking catalyst, to break carbon-carbon bonds and form hydrocarbons of lower average boiling point and/or lower average molecular weight than the starting average boiling point and average molecular weight of the hydrocarbon feed. Hydrocracking also includes ring opening of naphthenic rings into more linear-chain hydrocarbons.

The term "selective ring opening", as used herein, means a reaction or a process that tends to open naphthene rings without loss of reactant molecular weight.

The term "zeolite ring opening catalyst", as used herein, means a selective ring opening catalyst comprising a zeolite support. In some embodiments of this invention, the zeolite support comprises at least 1 wt % of zeolite. In some embodiments, the zeolite support comprises at least 2 wt %, 3 wt %, 4 wt %, 5 wt %, 6 wt %, 7 wt %, 8 wt %, 9 wt % or 10 wt % of zeolite. In some embodiments, the zeolite support comprises no more than 10 wt % of zeolite. In some embodiments, the zeolite support comprises from 1 wt % to about 10 wt % of zeolite.

In some embodiments of this invention, the zeolite support comprises, consists essentially of, or consists of a zeolite and an oxide. In some embodiments of this invention, the oxide is selected from the group consisting of alumina, titania, silica, silica-alumina, zirconia, and combinations thereof. In some embodiments, the zeolite support is essentially free of alumina. In some embodiments, the zeolite support comprises, consists essentially of, or consists of a zeolite and an alumina.

In some embodiments of this invention, the zeolite ring opening catalyst comprises, consists essentially of, or consists of a non-precious metal loaded on a zeolite support.

In some embodiments of this invention, the metal loaded on the zeolite support is nickel or cobalt, or combinations thereof, preferably combined with molybdenum and/or tungsten. In some embodiments, the metal is selected from the group consisting of nickel-molybdenum (NiMo), cobalt-molybdenum (CoMo), nickel-tungsten (NiW) and cobalt-tungsten (CoW). In some embodiments, the metal is nickel-tungsten (NiW) or cobalt-tungsten (CoW). In some embodiments, the metal is nickel-tungsten (NiW).

Zeolites used herein are crystalline, highly porous materials. They can be generically described as complex aluminosilicates characterized by a three-dimensional pore system. In some embodiments of this invention, the zeolite has a 8-member ring structure, a 10-member ring structure, or a 12-member ring structure. In some embodiments of this invention, the zeolite is selected from the group consisting of ZSM-48, ZSM-22, ZSM-23, ZSM-35, zeolite Beta, USY, ZSM-5, SSZ-31, SAPO-11, SAPO-41, MAPO-11, ECR-42, synthetic ferrierites, mordenite, offretite, erionite, chabazite, and combinations thereof.

The term "amorphous", as used herein, means that there is no substantial peak in a X-ray diffraction pattern of the subject solid.

The term "amorphous ring opening catalyst", as used herein, means a selective ring opening catalyst comprising an amorphous support. In some embodiments of this invention, the amorphous support comprises less than 1 wt % of zeolite. In some embodiments, the amorphous support comprises less than 0.5 wt % of zeolite. In some embodiments, the amorphous support comprises less than 0.1 wt % of zeolite. In some embodiments, the amorphous support is essentially free of zeolite.

In some embodiments of this invention, the amorphous support is selected from the group consisting of amorphous alumina, amorphous silica, amorphous silica alumina, amorphous titania, and combinations thereof. In some embodiments, the amorphous support is amorphous alumina, amorphous silica, or any of their combinations. In some embodiments, the amorphous support comprises, consists essentially of, or consists of amorphous alumina.

In some embodiments of this invention, an amorphous ring opening catalyst comprises, consists essentially of, or consists of a non-precious metal loaded on an amorphous support. In some embodiments, the metal is nickel or cobalt, or combinations thereof, preferably combined with molybdenum and/or tungsten. In some embodiments, the metal is selected from the group consisting of nickel-molybdenum (NiMo), cobalt-molybdenum (CoMo), nickel-tungsten (NiW) and cobalt-tungsten (CoW). In some embodiments, the metal is nickel-tungsten (NiW) or cobalt-tungsten (CoW). In some embodiments, the metal is nickel-tungsten (NiW).

The present disclosure provides a liquid-full process for hydroprocessing a hydrocarbon feed. The process comprises: (a) contacting the hydrocarbon feed with (i) a diluent and (ii) hydrogen, to produce a feed/diluent/hydrogen mixture, wherein the hydrogen is dissolved in the mixture to provide a liquid feed, and wherein the hydrocarbon feed is a light cycle oil (LCO) having a polyaromatic content greater than 25% by weight, a nitrogen content greater than 300 parts per million by weight (wppm), and a density greater than 890 kg/m$^3$ at 15.6° C.; (b) contacting the feed/diluent/hydrogen mixture with a first catalyst in a first liquid-full reaction zone, to produce a first product effluent; (c) contacting the first product effluent with a second catalyst in a second liquid-full reaction zone, to produce a second product effluent; and (d) recycling a portion of the second product effluent as a recycle product stream for use in the diluent in step (a)(i) at a recycle ratio of from about 1 to about 10; wherein the first catalyst is a hydrotreating catalyst and the second catalyst is a zeolite ring opening catalyst, the total amount of hydrogen fed to the process is greater than 100 normal liters of hydrogen per liter of the hydrocarbon feed, and the volume ratio of the total amount of the second catalyst to the total amount of the first catalyst is from about 0.2 to about 1.5.

The present disclosure also provides another liquid-full process for hydroprocessing a hydrocarbon feed. The process comprises: (a) contacting the hydrocarbon feed with (i) a diluent and (ii) hydrogen, to produce a feed/diluent/hydrogen mixture, wherein the hydrogen is dissolved in the mixture to provide a liquid feed, and wherein the hydrocarbon feed is a light cycle oil (LCO) having a polyaromatic content greater than 25% by weight, a nitrogen content greater than 300 parts per million by weight (wppm), and a density greater than 890 kg/m$^3$ at 15.6° C.; (b) contacting the feed/diluent/hydrogen mixture with a first catalyst in a first liquid-full reaction zone, to produce a first product effluent; (c) contacting the first product effluent with a second catalyst in a second liquid-full reaction zone, to produce a second product effluent; and (d) recycling a portion of the second product effluent as a recycle product stream for use in the diluent in step (a)(i) at a recycle ratio of from about 1 to about 10; wherein the first catalyst is a hydrotreating catalyst and the second catalyst is an amorphous ring opening catalyst, the total amount of hydrogen fed to the process is greater than 100 normal liters of hydrogen per liter of the hydrocarbon feed, and the volume ratio of the total amount of the second catalyst to the total amount of the first catalyst is from about 0.2 to about 3.0.

The hydroprocessing reactions of this invention take place in liquid-full reaction zones. By "liquid-full" it is meant herein that substantially all of the hydrogen is dissolved in a liquid-phase hydrocarbon feed mixture to a reaction zone wherein the liquid feed contacts a catalyst. In some embodiments of this invention, no gas phase hydrogen is present in the first liquid-full reaction zone or the second liquid-full reaction zone.

The hydrocarbon feed in the process of this disclosure is light cycle oil (LCO) and like material. Light cycle oil typically has a cetane index value less than 30, for example, a value in the range of about 15 to about 26; a polyaromatic content greater than 25% by weight and commonly in the range of about 40% by weight to about 60% by weight; a monoaromatic content greater than 10% by weight and commonly in the range of about 15% by weight to about 40% by weight; a total aromatic content greater than 50% by weight and commonly in the range of about 60% by weight to about 90% by weight; and, a density equal to or greater than 890 $kg/m^3$ (0.890 g/mL) measured at a temperature of 15.6° C. and usually greater than 900 $kg/m^3$ measured at a temperature of 15.6° C. Light cycle oil also typically has a nitrogen content greater than 300 parts per million by weight (wppm) and a sulfur content greater than 500 wppm. With the present process, a high percentage of the LCO is upgraded to high quality diesel.

It was found through experiments that the process of this disclosure can advantageously convert LCO to a diesel-range product in high yield. In some embodiments of this invention, the process of this disclosure can lower the density of the diesel product to about 860 $kg/m^3$ or less at a temperature of 15.6° C., and achieve desirable diesel properties, including sulfur content of less than 50 wppm, preferably less than 10 wppm, and increase cetane index by at least 12 points relative to the hydrocarbon feed. Preferably the cetane index is at least 27, can be from 27 to 42, and may be even higher. Other desirable properties of the diesel product include a minimum freeze point of −10° C. and a minimum flash point of 62° C. Diesel product is produced by distilling the second product effluent and removing the naphtha product.

The diluent typically comprises, consists essentially of, or consists of the recycle product stream which is a portion of the second product effluent that is recycled and combined with the hydrocarbon feed before or after contacting the feed with hydrogen, preferably before contacting the feed with hydrogen. In some embodiments, the diluent is the recycled portion of the second product effluent.

In some embodiments of this invention, the liquid-full process is conducted with a single recycle loop. By "single recycle loop" is meant herein, a portion (based on the selected recycle ratio) of the second product effluent is recirculated as a recycle product stream from the outlet of the second liquid-full reaction zone to the inlet of the first liquid-full reaction zone. Thus, all catalyst beds in the process are included in the one recycle loop. There is no separate recycle for just the first liquid-full reaction zone or just the second liquid-full reaction zone.

In some embodiments of this invention, the recycle ratio in step (d) is from about 2 to about 8. In some embodiments, the recycle ratio in step (d) is from about 4 to about 6.

In addition to recycle product stream, the diluent may comprise any other organic liquid that is compatible with the hydrocarbon feed and catalysts. When the diluent comprises an organic liquid in addition to the recycle product stream, preferably the organic liquid is a liquid in which hydrogen has a higher solubility compared with the hydrocarbon feed. The diluent may comprise an organic liquid selected from the group consisting of light hydrocarbons, light distillates, naphtha, and combinations thereof. In some embodiments, the organic liquid is selected from the group consisting of propane, butane, pentane, hexane, and combinations thereof. When the diluent comprises an organic liquid, the organic liquid is typically present in an amount of no greater than 90%, based on the total weight of the hydrocarbon feed and diluent, preferably 20-85%, and more preferably 50-80%.

In step (a) of the liquid-full process of this disclosure, a hydrocarbon feed is contacted with a diluent and hydrogen. The feed can be contacted first with hydrogen and then with the diluent, or preferably, first with the diluent and then with hydrogen to produce a feed/diluent/hydrogen mixture.

The feed/diluent/hydrogen mixture is contacted with a first catalyst in a first liquid-full reaction zone to produce a first product effluent.

The hydrocarbon feed is hydrotreated in the first liquid-full reaction zone. The hydrotreating process may include one or more of the following based on the hydrocarbon feed: hydrodesulfurization, hydrodenitrogenation, hydrodemetallation, hydrodeoxygenation, and hydrogenation.

The first catalyst can be any suitable hydrotreating catalyst that results in reducing the sulfur and/or nitrogen content of the hydrocarbon feed under the reaction conditions in the first liquid-full reaction zone. In some embodiments of this invention, the suitable hydrotreating catalyst comprises, consists essentially of, or consists of a non-precious metal and an oxide support. In some embodiments of this invention, the metal is nickel or cobalt, or combinations thereof, preferably combined with molybdenum and/or tungsten. In some embodiments, the metal is selected from the group consisting of nickel-molybdenum (NiMo), cobalt-molybdenum (CoMo), nickel-tungsten (NiW) and cobalt-tungsten (CoW). In some embodiments, the metal is nickel-molybdenum (NiMo) or cobalt-molybdenum (CoMo). In some embodiments, the metal is nickel-molybdenum (NiMo). The catalyst oxide support is a mono- or mixed-metal oxide. In some embodiments of this invention, the oxide support is selected from the group consisting of alumina, silica, titania, zirconia, kieselguhr, silica-alumina, and combinations of two or more thereof. In some embodiments, the oxide support comprises, consists essentially of, or consists of an alumina.

Each of the first and the second liquid-full reaction zone may independently comprise one or more reactors in liquid communication, and each reactor may independently comprise one or more catalyst beds. In some embodiments of this invention, the liquid-full process can be conducted in a single reactor comprising a first liquid-full reaction zone and a second liquid-full reaction zone, and each zone may independently comprise one or more catalyst beds.

In some embodiments of this invention, in a column reactor or other single vessel containing two or more catalyst beds or between multiple reactors, the beds are physically separated by a catalyst-free zone. In this disclosure, each reactor is a fixed bed reactor and may be of a plug flow, tubular or other design packed with a solid catalyst (i.e. a packed bed reactor).

In some embodiments of this invention, the first liquid-full reaction zone comprises two or more catalyst beds disposed in sequence, and the catalyst volume increases in each subsequent catalyst bed. Such two or more catalyst beds can be disposed in a single reactor or in two or more reactors disposed in sequence. As a result, the hydrogen consumption is more evenly distributed among the beds.

It was found through experiments that when catalyst distribution in first liquid-full reaction zone is uneven and catalyst volume increases with each subsequent catalyst bed, the same catalyst and the same volume catalyst provides higher sulfur and nitrogen conversion as compared to an even catalyst volume distribution.

In some embodiments of this invention, the first liquid-full reaction zone comprises two or more catalyst beds disposed in sequence, wherein each catalyst bed contains a catalyst having a catalyst volume, and wherein a distribution of the catalyst volumes among the catalyst beds is determined in a way so that the hydrogen consumption for each catalyst bed is essentially equal.

It was found through experiments that the essentially equal hydrogen consumption in each catalyst bed allows for minimizing the recycle ratio. A reduced recycle ratio results in increased sulfur, nitrogen, metal removal and increased aromatic saturation.

In some embodiments of this invention, hydrogen can be fed between the beds to increase hydrogen content in the product effluent between the catalyst beds. Hydrogen dissolves in the liquid effluent in the catalyst-free zone so that the catalyst bed is a liquid-full reaction zone. Thus, fresh hydrogen can be added into the feed/diluent/hydrogen mixture or effluent from a previous reactor (in series) at the catalyst-free zone, where the fresh hydrogen dissolves in the mixture or effluent prior to contact with the subsequent catalyst bed. A catalyst-free zone in advance of a catalyst bed is illustrated, for example, in U.S. Pat. No. 7,569,136.

In some embodiments of this invention, fresh hydrogen is added between each two catalyst beds. In some embodiments, fresh hydrogen is added at the inlet of each reactor. In some embodiments, fresh hydrogen is added between each two catalyst beds in the first liquid-full reaction zone and is also added at the inlet of the second liquid-full reaction zone. In some embodiments, fresh hydrogen is added at the inlet of each reactor in the first liquid-full reaction zone and is also added at the inlet of the second liquid-full reaction zone.

In the first liquid-full reaction zone, organic nitrogen and organic sulfur are converted to ammonia (hydrodenitrogenation) and hydrogen sulfide (hydrodesulfurization), respectively. There is no separation of ammonia and hydrogen sulfide and remaining hydrogen from the effluent of the first liquid-full reaction zone (first product effluent) prior to feeding the effluent to the second liquid-full reaction (ring opening) zone. The resulting ammonia and hydrogen sulfide after the hydrotreating step are dissolved in the liquid first product effluent.

Substantially no naphtha is made during the hydrotreating stage (i.e., first liquid-full reaction zone) and consequently the volume fraction of naphtha in the first product effluent produced in step (b) is low to nil.

In conventional processes, selective ring opening (i.e., second liquid-full reaction zone) is separated from hydrotreating (i.e., first liquid-full reaction zone) as two distinct processes due to poisoning effect of sulfur and nitrogen compounds on ring opening catalysts. Thus, such processes require a separation step to remove hydrogen sulfide and ammonia, especially ammonia, from a hydrotreated product. In an alternative process, gas is separated from product effluent before effluent is recycled. Both such separations are undesirable as they may cause loss of hydrogen from the product effluent. In some embodiments of this invention, hydrogen is recycled with the recycled portion of the second product effluent, without loss of gas phase hydrogen. In some embodiments of this invention, the recycled portion of the second product effluent is recycled and combined with the hydrocarbon feed without separating ammonia, hydrogen sulfide and remaining hydrogen from the second product effluent.

The second liquid-full reaction zone provides a selective ring opening process. The second catalyst can be a zeolite ring opening catalyst or an amorphous ring opening catalyst. The second catalyst, which is a selective ring opening catalyst, and the operating conditions in the second liquid-full reaction zone, such as temperature, pressure and liquid hourly space velocity (LHSV), are chosen to cause selective ring opening of the first product effluent and avoid cracking the first product effluent to lighter (e.g. naphtha) fractions. The reactions in this stage cause a beneficial decrease in density and increase in cetane index relative to that of the first product effluent.

Preferably, the first catalyst and the second catalyst are in the form of particles, more preferably shaped particles. By "shaped particle" it is meant the catalyst is in the form of an extrudate. Extrudates include cylinders, pellets, or spheres. Cylinder shapes may have hollow interiors with one or more reinforcing ribs. Trilobe, cloverleaf, rectangular- and triangular-shaped tubes, cross, and "C"-shaped catalysts can be used. Preferably a shaped catalyst particle is about 0.25 to about 13 mm (about 0.01 to about 0.5 inch) in diameter when a packed bed reactor is used. More preferably, a catalyst particle is about 0.79 to about 6.4 mm (about 1/32 to about 1/4 inch) in diameter. Such catalysts may be commercially available.

The catalysts may be sulfided before and/or during use by contacting the catalyst with a sulfur-containing compound at an elevated temperature. Suitable sulfur-containing compound include thiols, sulfides, disulfides, $H_2S$, or combinations of two or more thereof. The catalyst may be sulfided before use ("pre-sulfiding") or during the process ("sulfiding") by introducing a small amount of a sulfur-containing compound in the feed or diluent. The catalysts may be pre-sulfided in situ or ex situ and the feed or diluent may be supplemented periodically with added sulfur-containing compound to maintain the catalysts in sulfided condition. The Examples provide a pre-sulfiding procedure.

Both hydrotreating and selective ring opening processes of this disclosure contribute to high hydrogen demand and consumption. In the first and second liquid-full reaction zones, the total amount of hydrogen fed to the process is greater than 100 normal liters of hydrogen per liter of feed (N l/l) or greater than 560 scf/bbl. In some embodiments of this invention, the total amount of hydrogen fed to the process is from about 200 to about 530 N l/l (1125-3000 scf/bbl). In some embodiments, the total amount of hydrogen fed to the process is from about 300 to about 450 N l/l (1685-2527 scf/bbl).

The liquid-full process of this disclosure can operate under a wide variety of conditions. Temperature for both the first liquid-full reaction zone and the second liquid-full reaction zone can range from about 300° C. to about 450° C., and in some embodiments can range from about 300° C. to about 400° C. In some embodiments of this invention, the temperature of the first liquid-full reaction zone ranges from about 350° C. to about 400° C. In some embodiments, the temperature of the first liquid-full reaction zone ranges from about 350° C. to about 380° C. In some embodiments of this invention, the temperature of the second liquid-full reaction zone ranges from about 350° C. to about 400° C. In some embodiments, the temperature of the second liquid-full reaction zone ranges from about 370° C. to about 400° C.

Pressure for both the first liquid-full reaction zone and the second liquid-full reaction zone can range from about 3.45 MPa (34.5 bar) to about 17.3 MPa (173 bar), and in some embodiments can range from about 6.9 to about 13.9 MPa (69 to 139 bar). In some embodiments of this invention, the pressure for both the first liquid-full reaction zone and the second liquid-full reaction zone range from about 10 to about 13.9 MPa (100 to 139 bar).

A wide range of suitable catalyst concentrations may be used in the first and the second liquid-full reaction zones. In some embodiments, the catalyst is from about 10 wt % to about 50 wt % of the reactor contents for each reaction zone. The hydrocarbon feed is fed to the first liquid-full reaction zone at a rate to provide a liquid hourly space velocity (LHSV) of from about 0.1 to about 10 $hr^{-1}$. In some embodiments of this invention, the hydrocarbon feed is fed to the first liquid-full reaction zone at a liquid hourly space velocity (LHSV) of from about 0.2 to about 8.0 $hr^{-1}$. In some embodiments, the hydrocarbon feed is fed to the first liquid-full reaction zone at a liquid hourly space velocity (LHSV) of from about 0.4 to about 4.0 $hr^{-1}$.

The portion of the second product effluent not recycled is collected as the product stream. In some embodiments of this invention, the second product effluent comprises no more than 25 wt % of naphtha. In some embodiments, the second product effluent comprises no more than 20 wt %, 19 wt %, 18 wt %, 17 wt %, 16 wt %, 15 wt %, 14 wt %, 13 wt %, 12 wt %, 11 wt %, 10 wt %, 9 wt %, 8 wt %, 7 wt %, 6 wt %, 5 wt %, 4 wt %, or 3 wt % of naphtha.

In some embodiments of this invention, the density of the second product effluent is reduced by at least about 70 kg/$m^3$, 75 kg/$m^3$, 80 kg/$m^3$, 85 kg/$m^3$, or 90 kg/$m^3$ at 15.6° C. compared with the density of the hydrocarbon feed.

In some embodiments of this invention, the second product effluent cetane increase is at least about 10, 11, 12, 13, or 14.

In some embodiments of this invention, the second product effluent has a nitrogen content of no more than about 10, 9, 8, 7, 6, 5, 4, 3, 2, or 1 wppm.

In some embodiments of this invention, the second product effluent has a sulfur content of no more than about 50, 45, 40, 35, 30, 25, 20, 15, or 10 wppm.

In some embodiments of this invention, the second product effluent has a polyaromatic content of no more than about 10 wt %, 9 wt %, 8 wt %, 7 wt %, 6 wt %, 5 wt %, or 4 wt %.

The portion of the second product effluent not recycled may be processed further as desired prior to being distilled to produce the diesel-range product. For example, the second product effluent may be hydrotreated to remove sulfur compounds, such as mercaptans, prior to the distillation. For another example, gases, such as remaining hydrogen, $NH_3$, $H_2S$, and C1 to C4 hydrocarbons, may be removed prior to the distillation.

In some embodiments of this invention, the second product effluent is distilled to recover at least the diesel fraction. For example, the second product effluent may be fractionated to a naphtha fraction, a diesel fraction and a bottom fraction.

In some embodiments of this invention, the naphtha yield is no more than 25 wt %. In some embodiments, the naphtha yield is no more than 20 wt %, 19 wt %, 18 wt %, 17 wt %, 16 wt %, 15 wt %, 14 wt %, 13 wt %, 12 wt %, 11 wt %, 10 wt %, 9 wt %, 8 wt %, 7 wt %, 6 wt %, 5 wt %, 4 wt %, or 3 wt %.

In some embodiments of this invention, the yield of the diesel-range product is at least 75 wt %. In some embodiments, the yield of the diesel-range product is at least 80 wt %, 81 wt %, 82 wt %, 83 wt %, 84 wt %, 85 wt %, 86 wt %, 87 wt %, 88 wt %, 89 wt %, 90 wt %, 91 wt %, 92 wt %, 93 wt %, 94 wt %, 95 wt %, 96 wt %, or 97 wt %.

In some embodiments of this invention, the diesel product density reduction is at least about 65 kg/$m^3$ at 15.6° C. In some embodiments, the diesel product density reduction is at least about 70 kg/$m^3$ at 15.6° C. In some embodiments, the diesel product density reduction is at least about 75 kg/$m^3$ at 15.6° C. In some embodiments, the diesel product density reduction is at least about 80 kg/$m^3$ at 15.6° C.

In some embodiments of this invention, the diesel product cetane increase is at least about 10, 11, 12, 13, 14, 15 or 16.

In some embodiments of this invention, the diesel product has a nitrogen content of no more than about 10, 9, 8, 7, 6, 5, 4, 3, 2, or 1 wppm.

In some embodiments of this invention, the diesel product has a sulfur content of no more than about 50, 45, 40, 35, 30, 25, 20, 15, or 10 wppm.

In some embodiments of this invention, the diesel product has a polyaromatic content of no more than about 10 wt %, 9 wt %, 8 wt %, 7 wt %, 6 wt %, 5 wt %, or 4 wt %.

In some embodiments of this invention, the diesel product has sulfur content of less than 50 wppm, nitrogen content of less than 10 wppm, polyaromatics content of less than 10 wt. %, total aromatics content of less than 40 wt. %, and heavy metal content of less than 1 wppm.

In some embodiments of this invention, the naphtha yield is no more than 16 wt %, and the density of the diesel product is reduced by at least about 65 kg/$m^3$ at 15.6° C. compared with the density of the hydrocarbon feed. In some embodiments of this invention, the naphtha yield is no more than 10 wt %, and the density of the diesel product is reduced by at least about 70 kg/$m^3$ at 15.6° C. compared with the density of the hydrocarbon feed. In some embodiments of this invention, the naphtha yield is no more than about 6 wt %, and the density of the diesel product is reduced by at least about 70 kg/$m^3$ at 15.6° C. compared with the density of the hydrocarbon feed. In some embodiments of this invention, the naphtha yield is no more than about 5 wt %, and the density of the diesel product is reduced by at least about 70 kg/$m^3$ at 15.6° C. compared with the density of the hydrocarbon feed. In some embodiments of this invention, the naphtha yield is no more than about 5 wt %, and the density of the diesel product is reduced by at least about 75 kg/$m^3$ at 15.6° C. compared with the density of the hydrocarbon feed.

When the second catalyst is a zeolite ring opening catalyst, the volume ratio of the total amount of the second catalyst to the total amount of the first catalyst is from about 0.2 to about 1.5; in some embodiments, the volume ratio is from about 0.2 to about 1.2; in some embodiments, the volume ratio is from about 0.5 to about 1.2; in some embodiments, the volume ratio is from about 0.7 to about 1.2; in some embodiments, the volume ratio is from about 0.2 to 0.95; in some embodiments, the volume ratio is from about 0.5 to 0.95; in some embodiments, the volume ratio is from about 0.7 to 0.95; in some embodiments, the volume ratio is from about 0.80 to 0.95; in some embodiments, the volume ratio is from about 0.2 to about 0.90; in some embodiments, the volume ratio is from about 0.5 to about 0.90; in some embodiments, the volume ratio is from about 0.7 to about 0.90; and in some embodiments, the volume ratio is from about 0.80 to about 0.90.

In some embodiments, the volume ratio of the total amount of the zeolite ring opening catalyst to the total amount of the hydrotreating catalyst is from about 0.2 to about 1.2, the naphtha yield is no more than 16 wt %, and the density of the diesel product is reduced by at least about 65 kg/$m^3$ at 15.6° C. compared with the density of the hydrocarbon feed. In some embodiments, the volume ratio of the total amount of the zeolite ring opening catalyst to the total amount of the hydrotreating catalyst is from about 0.2 to 0.95, the naphtha yield is no more than 10 wt %, and the density of the diesel product is reduced by at least about 65 kg/$m^3$ at 15.6° C. compared with the density of the hydrocarbon feed. In some embodiments, the volume ratio of the total amount of the zeolite ring opening catalyst to the total amount of the hydrotreating catalyst is from about 0.2 to 0.95, the naphtha yield is no more than about 6 wt %, and the density of the diesel product is reduced by at least about 65 kg/$m^3$ at 15.6° C. compared with the density of the hydrocarbon feed. In some embodiments, the volume ratio of the total amount of the zeolite ring opening catalyst to the total amount of the hydrotreating catalyst is from about 0.5 to 0.95, the naphtha yield is no more than 10 wt %, and the density of the diesel product is reduced by at least about 70 kg/$m^3$ at 15.6° C. compared with the density of the hydrocarbon feed. In some embodiments, the volume ratio of the total amount of the zeolite ring opening catalyst to the total amount of the hydrotreating catalyst is from about 0.5 to 0.95, the naphtha yield is no more than about 6 wt %, and the density of the diesel product is reduced by at least about 70 kg/m$^3$ at 15.6° C. compared with the density of the hydrocarbon feed. In some embodiments, the volume ratio of the total amount of the zeolite ring opening catalyst to the total amount of the hydrotreating catalyst is from about 0.7 to 0.95, the naphtha yield is no more than about 6 wt %, and the density of the diesel product is reduced by at least about 70 kg/m$^3$ at 15.6° C. compared with the density of the hydrocarbon feed. In some embodiments, the volume ratio of the total amount of the zeolite ring opening catalyst to the total amount of the hydrotreating catalyst is from about 0.5 to about 0.90, the naphtha yield is no more than about 5 wt %, and the density of the diesel product is reduced by at least about 70 kg/m$^3$ at 15.6° C. compared with the density of the hydrocarbon feed. In some embodiments, the volume ratio of the total amount of the zeolite ring opening catalyst to the total amount of the hydrotreating catalyst is from about 0.7 to about 0.90, the naphtha yield is no more than about 5 wt %, and the density of the diesel product is reduced by at least about 70 kg/m$^3$ at 15.6° C. compared with the density of the hydrocarbon feed. In some embodiments, the volume ratio of the total amount of the zeolite ring opening catalyst to the total amount of the hydrotreating catalyst is from about 0.80 to 0.95, the naphtha yield is no more than about 6 wt %, and the density of the diesel product is reduced by at least about 75 kg/m$^3$ at 15.6° C. compared with the density of the hydrocarbon feed. In some embodiments, the volume ratio of the total amount of the zeolite ring opening catalyst to the total amount of the hydrotreating catalyst is from about 0.80 to about 0.90, the naphtha yield is no more than about 5 wt %, and the density of the diesel product is reduced by at least about 75 kg/m$^3$ at 15.6° C. compared with the density of the hydrocarbon feed.

In some embodiments, the volume ratio of the total amount of the zeolite ring opening catalyst to the total amount of the hydrotreating catalyst is from about 0.2 to about 1.2, the naphtha yield is no more than 16 wt %, the density of the diesel product is reduced by at least about 65 kg/m$^3$ at 15.6° C. compared with the density of the hydrocarbon feed, and the diesel product cetane increase is at least about 10. In some embodiments, the volume ratio of the total amount of the zeolite ring opening catalyst to the total amount of the hydrotreating catalyst is from about 0.5 to 0.95, the naphtha yield is no more than about 6 wt %, the density of the diesel product is reduced by at least about 70 kg/m$^3$ at 15.6° C. compared with the density of the hydrocarbon feed, and the diesel product cetane increase is at least about 11. In some embodiments, the volume ratio of the total amount of the zeolite ring opening catalyst to the total amount of the hydrotreating catalyst is from about 0.7 to about 0.90, the naphtha yield is no more than about 5 wt %, the density of the diesel product is reduced by at least about 70 kg/m$^3$ at 15.6° C. compared with the density of the hydrocarbon feed, and the diesel product cetane increase is at least about 11.

When the second catalyst is an amorphous ring opening catalyst, the volume ratio of the total amount of the second catalyst to the total amount of the first catalyst is from about 0.2 to about 3.0; in some embodiments, the volume ratio is from about 0.6 to about 3.0; in some embodiments, the volume ratio is from about 0.6 to about 2.5; in some embodiments, the volume ratio is from about 0.6 to about 2.0; in some embodiments, the volume ratio is from about 0.6 to about 1.6; in some embodiments, the volume ratio is from about 0.8 to about 1.6; in some embodiments, the volume ratio is from about 0.8 to about 1.4; in some embodiments, the volume ratio is from about 0.9 to about 1.4; in some embodiments, the volume ratio is from about 0.9 to about 1.3; in some embodiments, the volume ratio is from about 0.9 to about 1.2; in some embodiments, the volume ratio is from about 1.0 to about 1.4; in some embodiments, the volume ratio is from about 1.0 to about 1.3; and in some embodiments, the volume ratio is from about 1.0 to about 1.2.

In some embodiments of this invention, the volume ratio of the total amount of the amorphous ring opening catalyst to the total amount of the hydrotreating catalyst is from about 0.8 to about 1.4, the naphtha yield is no more than about 10 wt %, and the density of the diesel product is reduced by at least about 70 kg/m$^3$ at 15.6° C. compared with the density of the hydrocarbon feed.

In some embodiments of this invention, the volume ratio of the total amount of the amorphous ring opening catalyst to the total amount of the hydrotreating catalyst is from about 0.8 to about 1.4, the naphtha yield is no more than about 10 wt %, the density of the diesel product is reduced by at least about 70 kg/m$^3$ at 15.6° C. compared with the density of the hydrocarbon feed, and the diesel product cetane increase is at least about 10.

When the second catalyst is a zeolite ring opening catalyst, in some embodiments, the first product effluent produced in step (b) has a nitrogen content no more than about 10 wppm; in some embodiments, the first product effluent produced in step (b) has a nitrogen content no more than about 5 wppm; in some embodiments, the first product effluent produced in step (b) has a nitrogen content no more than about 2 wppm; in some embodiments, the first product effluent produced in step (b) has a nitrogen content in the range of from about 2 wppm to about 10 wppm.

When the second catalyst is an amorphous ring opening catalyst, in some embodiments, the first product effluent produced in step (b) has a nitrogen content no more than about 100 wppm; in some embodiments, the first product effluent produced in step (b) has a nitrogen content no more than about 50 wppm; in some embodiments, the first product effluent produced in step (b) has a nitrogen content no more than about 10 wppm.

Many aspects and embodiments have been described above and are merely exemplary and not limiting. After reading this specification, skilled artisans appreciate that other aspects and embodiments are possible without departing from the scope of the invention.

DESCRIPTION OF THE FIGURE

FIG. 1 provides an illustration for one embodiment of the hydrocarbon conversion process of this disclosure. Certain detailed features of the proposed process, such as pumps and compressors, separation equipment, feed tanks, heat exchangers, product recovery vessels and other ancillary process equipment are not shown for the sake of simplicity and in order to demonstrate the main features of the process. Such ancillary features will be appreciated by one skilled in the art. It is further appreciated that such ancillary and secondary equipment can be easily designed and used by one skilled in the art without any difficulty or any undue experimentation or invention.

FIG. 1 illustrates an integrated exemplary hydrocarbon processing unit 1. Fresh hydrocarbon feed, such a light cycle oil, is introduced via line 3 and combined with a portion of the effluent of reactor 55 (reactor 4) via line 19 at mixing point 2. The portion of the effluent in line 19 is pumped through pump 60 to mixing point 2 to provide combined liquid feed 4. A hydrogen gas stream is mixed with combined liquid feed 4 via line 6 at mixing point 5 to introduce sufficient hydrogen to saturate combined liquid feed 4. The resulting combined liquid feed/hydrogen mixture flows through line 7 into first hydrotreating reactor 25 (reactor 1).

The main hydrogen head 17 is the source for hydrogen make-up to all the reactors (reactors 1, 2, 3 and 4).

The effluent from hydrotreating bed 25, line 8 is mixed with additional fresh hydrogen gas fed via line 9 at mixing point 10 and the combined substantially liquid-stream flows via line 11 to second hydrotreating reactor 35 (reactor 2). The hydrotreated effluent exits hydrotreating reactor 35 via line 12. Hydrotreated effluent in line 12 is combined with additional fresh hydrogen gas fed via line 13 at mixing point 14 to provide a liquid feed. The liquid feed from mixing point 14 is fed via line 15 to first ring opening reactor 45 (reactor 3). The effluent from first ring opening reactor 45, line 16 is mixed with additional fresh hydrogen gas fed via line 24 at mixing point 26 and the combined substantially liquid-stream flows via line 28 to second ring opening reactor 55 (reactor 4). The effluent from the ring opening reactor 55 is removed via line 18. A portion of the effluent from line 18 is returned to first hydrotreating reactor 25 via line 19 through pump 60 to mixing point 2. The rest of the effluent from line 18 is sent via line 20 to control valve 70. From control valve 70, effluent is fed via line 21 to separator 80. Gas products are removed via line 22. Total Liquid Product (TLP) is removed via line 23. Product from line 23 may be fractioned (distilled) elsewhere to separate a smaller naphtha (gasoline) blending stock from a substantially larger amount of a diesel blending stock.

The liquid flow (hydrocarbon feed, recycle product stream, and hydrogen) in FIG. 1 is illustrated as downflow through the reactors 1-4. It is preferred that the feed/diluent/hydrogen mixture and product effluents are fed to the reactors in an downflow mode. However, an upflow process is also contemplated herein.

Figure 2:
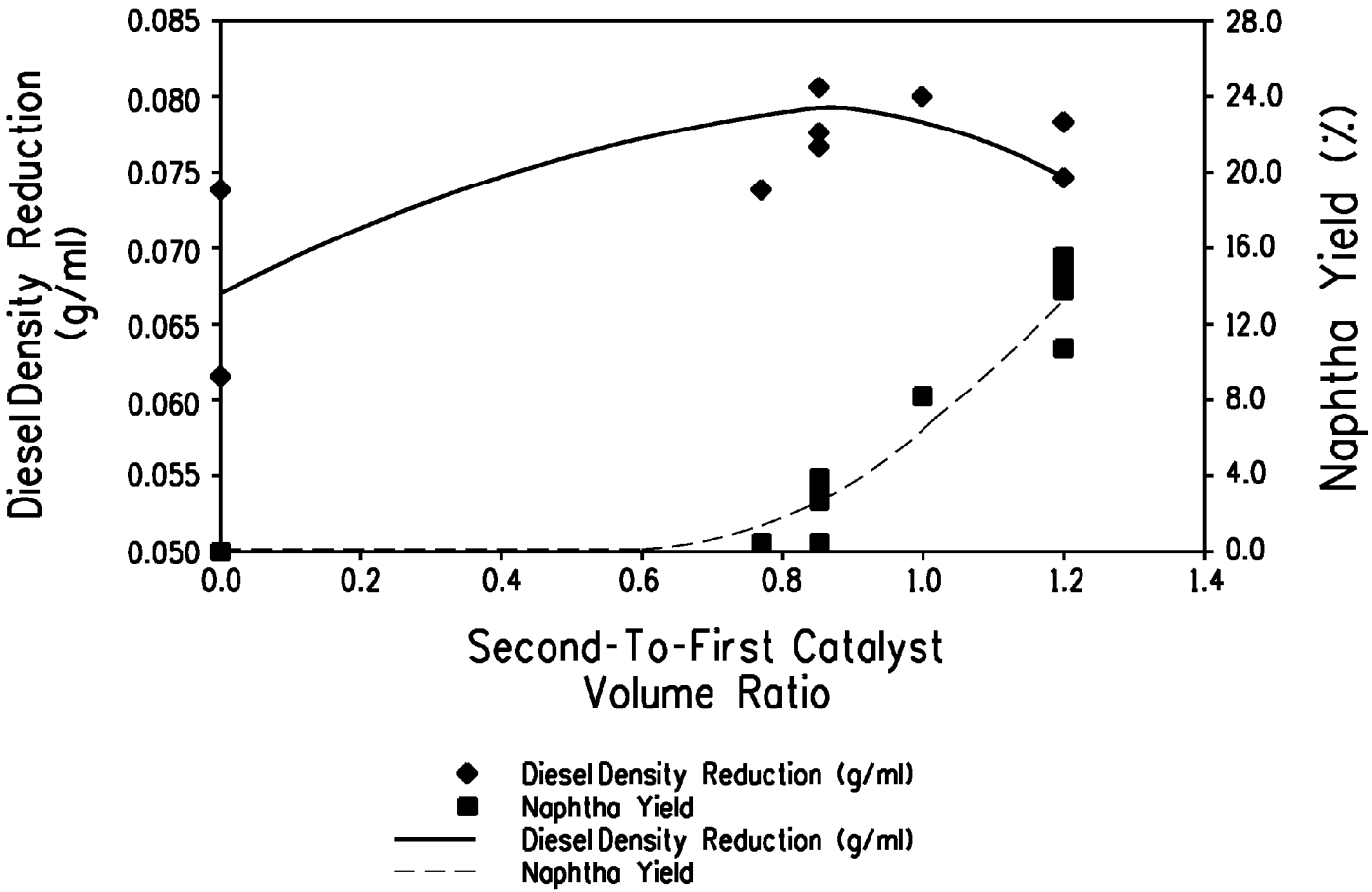
FIG. 2 shows the impact of the volume ratio of the total amount of the zeolite ring opening catalyst to the total amount of the hydrotreating catalyst on the naphtha yield and the diesel product density reduction.

FIG. 2 is a summary of the Examples results and illustrates the relationship of the naphtha yield and the diesel product density reduction with the volume ratio of the total amount of the zeolite ring opening catalyst to the total amount of the hydrotreating catalyst. The x-axis shows the volume ratio of the total amount of the zeolite ring opening catalyst to the total amount of the hydrotreating catalyst. The y-axis on the right shows the naphtha yield by weight percentage. The y-axis on the left shows the diesel product density reduction at 15.6° C.

FIG. 2 demonstrates that the naphtha yield increases as the catalyst ratio increases. However, the diesel product density reduction culminates with the catalyst ratio at about 0.80 to about 0.95.

EXAMPLES

The concepts described herein will be further described in the following examples, which do not limit the scope of the invention described in the claims.

Analytical Methods and Terms

ASTM Standards. All ASTM Standards are available from ASTM International, West Conshohocken, Pa., www.astm.org.

Amounts of sulfur and nitrogen are provided in parts per million by weight, wppm.

Total Sulfur was measured using ASTM D4294 (2008), "Standard Test Method for Sulfur in Petroleum and Petroleum Products by Energy Dispersive X-ray Fluorescence Spectrometry," DOI: 10.1520/D4294-08 and ASTM D7220 (2006), "Standard Test Method for Sulfur in Automotive Fuels by Polarization X-ray Fluorescence Spectrometry," DOI: 10.1520/D7220-06.

Total Nitrogen was measured using ASTM D4629 (2007), "Standard Test Method for Trace Nitrogen in Liquid Petroleum Hydrocarbons by Syringe/Inlet Oxidative Combustion and Chemiluminescence Detection," DOI: 10.1520/D4629-07 and ASTM D5762 (2005), "Standard Test Method for Nitrogen in Petroleum and Petroleum Products by Boat-Inlet Chemiluminescence," DOI: 10.1520/D5762-05.

Aromatic content was determined using ASTM Standard D5186-03(2009), "Standard Test Method for Determination of Aromatic Content and Polynuclear Aromatic Content of Diesel Fuels and Aviation Turbine Fuels by Supercritical Fluid Chromatography", DOI: 10.1520/D5186-03R09.

Boiling point distribution was determined using ASTM D2887 (2008), "Standard Test Method for Boiling Range Distribution of Petroleum Fractions by Gas Chromatography," DOI: 10.1520/D2887-08. ASTM D86 equivalent boiling points were calculated using correlations provided within ASTM D2887 standard.

Density, Specific Gravity and API Gravity were measured using ASTM Standard D4052 (2009), "Standard Test Method for Density, Relative Density, and API Gravity of Liquids by Digital Density Meter," DOI: 10.1520/D4052-09.

"API gravity" refers to American Petroleum Institute gravity, which is a measure of how heavy or light a petroleum liquid is compared to water. If API gravity of a petroleum liquid is greater than 10, it is lighter than water and floats; if less than 10, it is heavier than water and sinks. API gravity is thus an inverse measure of the relative density of a petroleum liquid and the density of water, and is used to compare relative densities of petroleum liquids.

The formula to obtain API gravity of petroleum liquids from specific gravity (SG) is:

$$\text{API gravity}=(141.5/SG)-131.5$$

Cetane index is useful to estimate cetane number (measure of combustion quality of a diesel fuel) when a test engine is not available or if sample size is too small to determine this property directly. Cetane index was determined by ASTM Standard D4737 (2009a), "Standard Test Method for Calculated Cetane Index by Four Variable Equation," DOI: 10.1520/D4737-09a.

"WABT" means weighted average bed temperature.

The following examples are presented to illustrate specific embodiments of the present disclosure and not to be considered in any way as limiting the scope of the invention.

Examples 1-6

The properties of a light cycle oil (LCO) from a commercial refiner used in Examples 1-6 are shown in Table 1. The LCO was hydroprocessed in an experimental pilot unit containing three to five fixed bed reactors in series. Each reactor was of 19 mm (¾") OD 316L stainless steel tubing and about 49 cm (19¼") to 61 cm (24") in length with reducers to 6 mm (¼") on each end. Both ends of the reactors were first capped with metal mesh to prevent catalyst leakage. Below the metal mesh, the reactors were packed with layers of 1 mm glass beads at both ends. Catalyst was packed in the middle section of the reactor.

TABLE 1

| Properties of Light Cycle Oil Used in Examples 1-6 | | |
|---|---|---|
| Property | Unit | Value |
| Sulfur | wppm | 3864 |
| Nitrogen | wppm | 913 |
| Density at 15.6° C. (60° F.) | g/ml | 0.936 |
| API Gravity | | 19.5 |
| Polyaromatic Compounds | wt % | 38.8 |
| Total Aromatic Compounds | wt % | 71.8 |
| Cetane Index | | 26.2 |
| Boiling Point Distribution | | |
| | Simulated Distillation, wt % | ° C. (° F.) |
| IBP = Initial boiling point | IBP | 116 (241) |
| | 5 | 195 (383) |
| | 10 | 214 (417) |
| | 20 | 236 (457) |
| | 30 | 256 (493) |
| | 40 | 271 (520) |
| | 50 | 287 (548) |
| | 60 | 305 (580) |
| | 70 | 324 (616) |
| | 80 | 347 (657) |
| | 90 | 370 (698) |
| | 95 | 389 (732) |
| | 99 | 422 (791) |
| FBP = Final boiling point | FBP | 431 (807) |

The first three reactors, Reactors 1, 2, and 3, contained a hydrotreating catalyst for hydrodenitrogenation (HDN), hydrodesulfurization (HDS) and hydrodearomatization (HDA). About 18 ml, 52 ml, and 80 ml of catalyst were loaded in the first, second, and third reactors, respectively. The catalyst, KF-860, was a NiMo on $\gamma$-$Al_2O_3$ support from Albemarle Corp., Baton Rouge, La. It was in the form of extrudates of a quadralobe about 1.3 mm diameter and 10 mm long. Reactor 1 was packed with layers of 33 ml (bottom) and 34 ml (top) of glass beads; Reactor 2 was packed with a layer of 16 ml (bottom) and 17 ml (top) of glass beads; and Reactor 3 was packed with a layer of 2 ml (bottom) and 3 ml (top) of glass beads.

Reactors 4 and 5 contained different amounts of the zeolite ring opening catalyst KC-2610 to get different hydrocracking-to-hydrotreating catalyst volume ratios for the different Examples. This catalyst, KC-2610, was a NiW catalyst on a zeolite support from Albemarle. It was in the form of extrudates of a cylindrical shape of about 1.5 mm diameter and 10 mm long.

Each reactor was placed in a temperature controlled sand bath in a 7.6 cm (3") OD and 120 cm long pipe filled with fine sand. Temperature was monitored at the inlet and outlet of each reactor as well as in each sand bath. The temperature in each reactor was controlled using heat tapes wrapped around the 3" OD pipe and connected to temperature controllers. After exiting Reactor 5 in Examples 1-4 and Reactor 3 in Examples 5-6, the effluent was split into a recycle product stream and a product effluent. The liquid recycle stream flowed through a piston metering pump, to join a fresh hydrocarbon feed at the inlet of the first reactor.

Hydrogen was fed from compressed gas cylinders and the flow rates were measured using mass flow controllers. The hydrogen was injected and mixed with the combined fresh LCO feed and the recycle product stream before Reactor 1. The combined "fresh LCO/hydrogen/recycle product stream" stream flowed downwardly through a first temperature-controlled sand bath in a 6 mm OD tubing and then in an up-flow mode through Reactor 1. After exiting Reactor 1, additional hydrogen was injected in the effluent of Reactor 1 (feed to Reactor 2). The feed to Reactor 2 flowed downwardly through a second temperature-controlled sand bath in a 6 mm OD tubing and then in an up-flow mode through Reactor 2. After exiting Reactor 2, more hydrogen was dissolved in the effluent of Reactor 2 (feed to Reactor 3). The liquid feed to Reactors 3, 4, and 5 followed the same pattern, with hydrogen gas injection before each reactor.

In Examples 1-4, both the hydrotreating catalyst (total 150 ml) and the zeolite ring opening catalyst (total 180 ml for Examples 1-2 and total 130 ml for Examples 3-4) were charged to the reactors as described above. In Examples 5-6, only the hydrotreating catalyst (total 150 ml) was charged to get a zero hydrocracking-to-hydrotreating catalyst volume ratio. The catalysts were dried overnight at 115° C. under a total flow of 210 to 350 standard cubic centimeters per minute (sccm) of hydrogen. The pressure was 6.9 MPa (69 bar). The catalyst-charged reactors were heated to 176° C. with a flow of charcoal lighter fluid through the catalyst beds. Sulfur spiking agent (1 wt % sulfur, added as 1-dodecanethiol) and hydrogen gas were introduced into the charcoal lighter fluid at 176° C. to start to pre-sulfide the catalysts. The pressure was 6.9 MPa (69 bar). The temperature in each reactor was increased gradually to 320° C. Pre-sulfiding was continued at 320° C. until a breakthrough of hydrogen sulfide ($H_2S$) at the outlet of the last Reactor. After pre-sulfiding, the catalysts were stabilized by flowing a straight run diesel (SRD) feed through the catalyst beds at a temperature from 320° C. to 355° C. and at 6.9 MPa (1000 psig or 69 bar) for 10 hours.

After pre-sulfiding and stabilizing the catalysts, fresh LCO feed was pumped to Reactor 1 using a reciprocating pump at a flow rate to target a total LHSV of 0.40-0.60 $hr^{-1}$. Total hydrogen feed rate was 342-450 normal liters per liter (N l/l) of fresh hydrocarbon feed (1900-2500 scf/bbl). Reactors 1, 2, and 3 each had a weighted average bed temperature or WABT of 366° C. For Examples 1-4, Reactors 4 and 5 each had a WABT of 379-382° C. Pressure was 13.8 MPa (2000 psig or 138 bar). The recycle ratio was 6. The pilot unit was kept at these conditions for an additional 6-10 hours in each Example to assure that the catalyst was fully precoked and the system was lined-out while testing product samples for total sulfur, total nitrogen, bulk density, simulated distillation for boiling point distribution, and aromatic compounds. The boiling point distribution was used to determine the naphtha yield. The diesel density was determined based on the Total Liquid Product (TLP) density and the correlation between the naphtha yield and the density increase from TLP to diesel. Such correlation is shown in Table 2. The feed and process conditions for Examples 1-6 are provided in Table 3 and the results are provided in Table 4.

TABLE 2

| Correlation between the Naphtha Yield and the Density Increase from TLP to Diesel | |
|---|---|
| Naphtha Yield (wt %) | Density Increase from TLP to Diesel (g/ml) |
| 5.8 | 0.0135 |
| 8.1 | 0.0130 |
| 15.1 | 0.0184 |
| 15.6 | 0.0228 |
| 18.4 | 0.0251 |
| 28.3 | 0.0355 |
| 31.9 | 0.0378 |
| 33.4 | 0.0365 |

TABLE 3

| Feed and Process Conditions for Examples 1-6 | | | | | | | |
|---|---|---|---|---|---|---|---|
| Hydrocarbon Feed | | | | | | | |
| Feed Density$^{15.6° C.}$ g/ml | Feed Sulfur wppm | Feed Nitrogen wppm | Feed Polyaromatics wt % | Feed Total Aromatics wt % | Feed Cetane Index | | |
| 0.936 | 3864 | 913 | 38.8 | 71.8 | 26.2 | | |
| Hydroprocessing Conditions | | | | | | | |
| HDT catalyst in Reactors 1-3 | SRO catalyst in Reactors 4-5 | Pressure MPa | HDT WABT ° C. | SRO WABT ° C. | Total LHSV $hr^{-1}$ | RR | |
| Type II NiMo | Zeolite Ni/W | 13.8 | 366 | 379 to 382 | 0.4 to 0.6 | 6 | |

HDT is hydrotreating
SRO is selective ring opening
RR is recycle ratio

TABLE 4

| Summary of Examples 1-6 | | | | | | | | | |
|---|---|---|---|---|---|---|---|---|---|
| Ex. No. | SRO/HDT catalyst volume ratio | TLP Density at 15.6° C. (g/ml) | TLP Sulfur wppm | TLP Nitrogen wppm | Naphtha Yield wt % | Diesel Density at 15.6° C (g/ml) | TLP Poly-aromatics wt % | TLP Total Aromatics wt % | TLP Cetane Index |
| 1 | 1.20 | 0.847 | 38.7 | 2.7 | 13.9 | 0.867 | 6.7 | 36.0 | 37.7 |
| 2 | 1.20 | 0.840 | 35.6 | 1.7 | 15.2 | 0.862 | | | 39.6 |
| 3 | 0.87 | 0.856 | 27.4 | 0.2 | 0.6 | 0.859 | 4.0 | 28.5 | 40.4 |
| 4 | 0.87 | 0.851 | 23.0 | 0.1 | 3.8 | 0.860 | 3.8 | 26.5 | 39.8 |
| 5 | 0 | 0.863 | 4.8 | 0 | 0 | 0.863 | 2.7 | 21.1 | 39.6 |
| 6 | 0 | 0.874 | 22.1 | 0.2 | 0 | 0.874 | 4.2 | 30.5 | 37.6 |

In Examples 1-2, there was 1.20 times as much zeolite ring opening catalyst as hydrotreating catalyst in the reaction zones; in Examples 3-4, there was 0.87 times as much zeolite ring opening catalyst as hydrotreating catalyst in the reaction zones; and in Examples 5-6, there was only hydrotreating catalyst and no zeolite ring opening catalyst present in the reaction zone. The amount of naphtha yield (diesel loss) decreased as the volume ratio of the zeolite ring opening catalyst to the hydrotreating catalyst decreased from Examples 1 and 2 to Examples 5 and 6. The diesel product density reduction was at its maximum (lowest diesel density) in Examples 3 and 4 with 0.87 catalyst volume ratio. In Examples 3 and 4, the diesel product density reduction was 0.076-0.077 g/ml. Naphtha yield was 0.6-3.8 wt % and nitrogen content was less than 2 wppm. Polyaromatics were reduced from 39 wt % to about 4 wt % and the cetane index was increased from 26 to about 40.

Examples 7-10

The properties of a different light cycle oil (LCO) from a different commercial refiner used in Examples 7-10 are shown in Table 5. The LCO was hydroprocessed in an experimental pilot unit containing five fixed bed reactors in series. Each reactor was of 19 mm (¾") OD 316L stainless steel tubing and about 49 cm (19¼") to 61 cm (24") in length with reducers to 6 mm (¼") on each end. Both ends of the reactors were first capped with metal mesh to prevent catalyst leakage. Below the metal mesh, the reactors were packed with layers of 1 mm glass beads at both ends. Catalyst was packed in the middle section of the reactor.

TABLE 5

| Properties of Light Cycle Oil Used in Examples 7-10 | | |
|---|---|---|
| Property | Unit | Value |
| Sulfur | wppm | 3243 |
| Nitrogen | wppm | 1031 |
| Density at 15.6° C. (60° F.) | g/ml | 0.960 |
| API Gravity | | 15.7 |
| Polyaromatic Compounds | wt % | 46.0 |
| Total Aromatic Compounds | wt % | 66.7 |
| Cetane Index | | 23.9 |
| Boiling Point Distribution | | |
| | Simulated Distillation, wt % | ° C. (° F.) |
| IBP = Initial boiling point | IBP | 126 (258) |
| | 5 | 214 (418) |
| | 10 | 235 (455) |
| | 20 | 257 (495) |
| | 30 | 271 (519) |
| | 40 | 285 (544) |
| | 50 | 304 (579) |
| | 60 | 322 (611) |
| | 70 | 342 (647) |
| | 80 | 363 (685) |
| | 90 | 389 (732) |
| | 95 | 408 (766) |
| | 99 | 430 (806) |
| FBP = Final boiling point | FBP | 436 (816) |

The first three reactors, Reactors 1, 2, and 3, contained the same hydrotreating catalyst as used in Examples 1-6 for hydrodenitrogenation (HDN), hydrodesulfurization (HDS) and hydrodearomatization (HDA). In Examples 7 and 10, about 22 ml, 56 ml, and 90 ml of catalyst were loaded in the first, second, and third reactors, respectively. In Examples 8 and 9, about 18 ml, 52 ml, and 80 ml of catalyst were loaded in the first, second, and third reactors, respectively. The catalyst, KF-860, was a NiMo on $\gamma$-$Al_2O_3$ support from Albemarle Corp., Baton Rouge, La. The remaining top and bottom portions of the reactors were packed with glass beads in a similar fashion as Examples 1-6.

Reactors 4 and 5 contained different amounts of the zeolite ring opening catalyst KC-2610, same catalyst as used in Examples 1-4, to get different hydrocracking-to-hydrotreating catalyst volume ratios for the different Examples. This catalyst, KC-2610, was a NiW catalyst on a zeolite support from Albemarle.

Each reactor was placed in a temperature controlled sand bath in a 7.6 cm (3") OD and 120 cm long pipe filled with fine sand. Temperature was monitored at the inlet and outlet of each reactor as well as in each sand bath. The temperature in each reactor was controlled using heat tapes wrapped around the 3" OD pipe and connected to temperature controllers. After exiting Reactor 5, the effluent was split into a recycle product stream and a product effluent. The liquid recycle stream flowed through a piston metering pump, to join a fresh hydrocarbon feed at the inlet of the first reactor.

Hydrogen was fed from compressed gas cylinders and the flow rates were measured using mass flow controllers. The hydrogen was injected and mixed with the combined fresh LCO feed and the recycle product stream before Reactor 1. The combined "fresh LCO/hydrogen/recycle product stream" stream flowed downwardly through a first temperature-controlled sand bath in a 6 mm OD tubing and then in an up-flow mode through Reactor 1. After exiting Reactor 1, additional hydrogen was injected in the effluent of Reactor 1 (feed to Reactor 2). The feed to Reactor 2 flowed downwardly through a second temperature-controlled sand bath in a 6 mm OD tubing and then in an up-flow mode through Reactor 2. After exiting Reactor 2, more hydrogen was dissolved in the effluent of Reactor 2 (feed to Reactor 3). The liquid feed to Reactors 3, 4, and 5 followed the same pattern, with hydrogen gas injection before each reactor.

Both the hydrotreating catalyst (total 168 ml for Examples 7 and 10 and 150 ml for Examples 8 and 9) and the zeolite ring opening catalyst (total 126 ml for Examples 7, 130 ml for Examples 8, and 180 ml for Examples 9-10) were charged to the reactors as described above. The catalysts were dried overnight at 115° C. under a total flow of 210 to 350 standard cubic centimeters per minute (sccm) of hydrogen. The pressure was 6.9 MPa (69 bar). The catalyst-charged reactors were heated to 176° C. with a flow of charcoal lighter fluid through the catalyst beds. Sulfur spiking agent (1 wt % sulfur, added as 1-dodecanethiol) and hydrogen gas were introduced into the charcoal lighter fluid at 176° C. to start to pre-sulfide the catalysts. The pressure was 6.9 MPa (69 bar). The temperature in each reactor was increased gradually to 320° C. Pre-sulfiding was continued at 320° C. until a breakthrough of hydrogen sulfide ($H_2S$) at the outlet of the last Reactor. After pre-sulfiding, the catalysts were stabilized by flowing a straight run diesel (SRD) feed through the catalyst beds at a temperature from 320° C. to 355° C. and at 6.9 MPa (1000 psig or 69 bar) for 10 hours.

After pre-sulfiding and stabilizing the catalysts, fresh LCO feed was pumped to Reactor 1 using a reciprocating pump at a flow rate to target a total LHSV of 0.25-0.50 $hr^{-1}$. Total hydrogen feed rate was 342-450 normal liters per liter (N l/l) of fresh hydrocarbon feed (1900-2500 scf/bbl). Reactors 1, 2, and 3 each had a weighted average bed temperature or WABT of 360-366° C. Reactors 4 and 5 each had a WABT of 377-382° C. Pressure was 13.8 MPa (2000 psig or 138 bar). The recycle ratio was 6. The pilot unit was kept at these conditions for an additional 6-10 hours in each Example to assure that the catalyst was fully precoked and the system was lined-out while testing product samples for total sulfur, total nitrogen, bulk density, simulated distillation for boiling point distribution, and aromatic compounds. The boiling point distribution was used to determine the naphtha yield. The diesel density was determined based on the Total Liquid Product (TLP) density and the correlation between the naphtha yield and the density increase from TLP to diesel. Such correlation is shown in Table 2. The feed and process conditions for Examples 7-10 are provided in Table 6 and the results are provided in Table 7.

TABLE 6

Feed and Process Conditions for Examples 7-10

| Hydrocarbon Feed | | | | | |
|---|---|---|---|---|---|
| Feed Density$^{15.6° C.}$ g/ml | Feed Sulfur wppm | Feed Nitrogen wppm | Feed Polyaromatics wt % | Feed Total Aromatics wt % | Feed Cetane Index |
| 0.960 | 3243 | 1031 | 46.0 | 66.7 | 23.9 |

| Hydroprocessing Conditions | | | | | | |
|---|---|---|---|---|---|---|
| HDT catalyst in Reactors 1-3 | SRO catalyst in Reactors 4-5 | Pressure MPa | HDT WABT ° C | SRO WABT ° C. | Total LHSV $hr^{-1}$ | RR |
| Type II NiMo | Zeolite Ni/W | 13.8 | 360 to 366 | 377 to 382 | 0.25 to 0.47 | 6 |

HDT is hydrotreating

SRO is selective ring opening

RR is recycle ratio

TABLE 7

Summary of Examples 7-10

| Ex. No. | SRO/HDT catalyst volume ratio | TLP Density at 15.6° C. (g/ml) | TLP Sulfur wppm | TLP Nitrogen wppm | Naphtha Yield wt % | Diesel Density at 15.6° C. (g/ml) | TLP Poly-aromatics wt % | TLP Total Aromatics wt % | TLP Cetane Index |
|---|---|---|---|---|---|---|---|---|---|
| 7 | 0.75 | 0.887 | 39.9 | 2.5 | 0.4 | 0.887 | 6.9 | 38.1 | 35.3 |
| 8 | 0.87 | 0.872 | 15.1 | 0.9 | 2.7 | 0.879 | 5.2 | 30.6 | 37.2 |
| 9 | 1.20 | 0.865 | 40.0 | 5.0 | 10.3 | 0.882 | | | 36.4 |
| 10 | 1.00 | 0.865 | 25.8 | 5.9 | 8.3 | 0.880 | | | 36.5 |

In Examples 7, 8, 9, and 10, there was 0.75, 0.87, 1.20, and 1.00 times as much zeolite ring opening catalyst as hydrotreating catalyst in the reaction zones, respectively. The amount of naphtha yield (diesel loss) decreased as the volume ratio of the zeolite ring opening catalyst to the hydrotreating catalyst decreased across the Examples. The diesel product density reduction was at its maximum (lowest diesel density) in Example 8 with 0.87 catalyst volume ratio. In Example 8, the diesel product density reduction was 0.081 g/ml. Naphtha yield was 2.7 wt % and nitrogen content was less than 2 wppm. Polyaromatics were reduced from 46 wt % to 5 wt % and the cetane index was increased from 24 to 37.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification is to be regarded in an illustrative rather than a restrictive sense, and all such modifications are intended to be included within the scope of invention.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

It is to be appreciated that certain features are, for clarity, described herein in the context of separate embodiments, may also be provided in combination in a single embodiment. Conversely, various features that are, for brevity, described in the context of a single embodiment, may also be provided separately or in any subcombination.

What is claimed is:

1. A liquid-full process for hydroprocessing a hydrocarbon feed, comprising:

(a) contacting the hydrocarbon feed with (i) a diluent and (ii) hydrogen, to produce feed/diluent/hydrogen mixture, wherein the hydrogen is dissolved in the mixture to provide a liquid feed, and wherein the hydrocarbon feed is a light cycle oil (LCO) having a polyaromatic content greater than 25% by weight, a nitrogen content greater than 300 parts per million by weight (wppm), and a density greater than 890 kg/m$^3$ at 15.6° C.;

(b) contacting the feed/diluent/hydrogen mixture with a first catalyst in a first liquid-full reaction zone, to produce a first product effluent;

(c) contacting the first product effluent with a second catalyst in a second liquid-full reaction zone, to produce a second product effluent; and (d) recycling a portion of the second product effluent as a recycle product stream for use in the diluent in step (a)(i) at a recycle ratio of from about 1 to about 10;

wherein the first catalyst is a hydrotreating catalyst and the second catalyst is a zeolite ring opening catalyst, the total amount of hydrogen fed to the process is greater than 100 normal liters of hydrogen per liter of the hydrocarbon feed, and the volume ratio of the total amount of the second catalyst to the total amount of the first catalyst is from about 0.2 to about 1.5; and wherein the recycled portion of the second product effluent is recycled without separating ammonia, hydrogen sulfide, and remaining hydrogen from the second product effluent.

2. The liquid-full process of claim 1, wherein the volume ratio of the total amount of the second catalyst to the total amount of the first catalyst is from about 0.2 to about 1.2.

3. The liquid-full process of claim 1, wherein the volume ratio of the total amount of the second catalyst to the total amount of the first catalyst is from about 0.2 to 0.95.

4. The liquid-full process of claim 1, wherein the volume ratio of the total amount of the second catalyst to the total amount of the first catalyst is from about 0.7 to 0.95.

5. The liquid-full process of claim 4, wherein naphtha yield of the process is no more than about 6 wt %, and the density of diesel product is reduced by at least about 70 kg/m$^3$ at 15.6° C. compared with the density of the hydrocarbon feed.

6. The liquid-full process of claim 4, wherein diesel product cetane increase is at least about 11.

7. The liquid-full process of claim 1, wherein the first product effluent is contacted with the second catalyst without prior separation of ammonia, hydrogen sulfide, and remaining hydrogen from the first product effluent.

8. The liquid-full process of claim 1, wherein the first product effluent produced in step (b) has a nitrogen content no more than about 10 wppm.

9. The liquid-full process of claim 1, wherein the first product effluent produced in step (b) has a nitrogen content no more than about 2 wppm.

10. The liquid-full process of claim 1, wherein the zeolite ring opening catalyst comprises nickel-tungsten (NiW) loaded on a zeolite support.

11. A liquid-full process for hydroprocessing a hydrocarbon feed, comprising:

(a) contacting the hydrocarbon feed with (i) a diluent and (ii) hydrogen, to produce a feed/diluent/hydrogen mixture, wherein the hydrogen is dissolved in the mixture to provide a liquid feed, and wherein the hydrocarbon feed is a light cycle oil (LCO) having a polyaromatic content greater than 25% by weight, a nitrogen content greater than 300 parts per million by weight (wppm), and a density greater than 890 kg/m$^3$ at 15.6° C.;

(b) contacting the feed/diluent/hydrogen mixture with a first catalyst in a first liquid-full reaction zone, to produce a first product effluent;

(c) contacting the first product effluent with a second catalyst in a second liquid-full reaction zone, to produce a second product effluent; and (d) recycling a portion of the second product effluent as a recycle product stream for use in the diluent in step (a)(i) at a recycle ratio of from about 1 to about 10;

wherein the first catalyst is a hydrotreating catalyst and the second catalyst is an amorphous ring opening catalyst, the total amount of hydrogen fed to the process is greater than 100 normal liters of hydrogen per liter of the hydrocarbon feed, and the volume ratio of the total amount of the second catalyst to the total amount of the first catalyst is from about 0.2 to about 3.0; and wherein the recycled portion of the second product effluent is recycled without separating ammonia, hydrogen sulfide, and remaining hydrogen from the second product effluent.

12. The liquid-full process of claim 11, wherein the volume ratio of the total amount of the second catalyst to the total amount of the first catalyst is from about 0.6 to about 2.0.

13. The liquid-full process of claim 11, wherein the volume ratio of the total amount of the second catalyst to the total amount of the first catalyst is from about 0.8 to about 1.4.

14. The liquid-full process of claim 13, wherein naphtha yield of the process is no more than about 10 wt %, and the density of diesel product is reduced by at least about 70 kg/m$^3$ at 15.6° C. compared with the density of the hydrocarbon feed.

15. The liquid-full process of claim 13, wherein diesel product cetane increase is at least about 10.

16. The liquid-full process of claim 11, wherein the first product effluent produced in step (b) has a nitrogen content no more than about 100 wppm.

17. The liquid-full process of claim 11, wherein the first product effluent is contacted with the second catalyst without prior separation of ammonia, hydrogen sulfide, and remaining hydrogen from the first product effluent.

18. The liquid-full process of claim 11, wherein the amorphous ring opening catalyst comprises nickel-tungsten (NiW) loaded on an amorphous support.

19. A liquid-full process for hydroprocessing a hydrocarbon feed, comprising:

(a) contacting the hydrocarbon feed with (i) a diluent and (ii) hydrogen, to produce a feed/diluent/hydrogen mixture, wherein the hydrogen is dissolved in the mixture to provide a liquid feed, and wherein the hydrocarbon feed is a light cycle oil (LCO) having a polyaromatic content greater than 25% by weight, a nitrogen content greater than 300 parts per million by weight (wppm), and a density greater than 890 kg/m$^3$ at 15.6° C.;

(b) contacting the feed/diluent/hydrogen mixture with a first catalyst in a first liquid-full reaction zone, to produce a first product effluent;

(c) contacting the first product effluent with a second catalyst in a second liquid-full reaction zone, to produce a second product effluent; and (d) recycling a portion of the second product effluent as a recycle product stream for use in the diluent in step (a)(i) at a recycle ratio of from about 1 to about 10;

wherein the first catalyst is a hydrotreating catalyst and the second catalyst is a zeolite ring opening catalyst, the total amount of hydrogen fed to the process is greater than 100 normal liters of hydrogen per liter of the hydrocarbon feed, and the volume ratio of the total amount of the second catalyst to the total amount of the first catalyst is from about 0.2 to 0.95.

20. The liquid-full process of claim 19, wherein the volume ratio of the total amount of the second catalyst to the total amount of the first catalyst is from about 0.7 to 0.95.

21. The liquid-full process of claim 20, wherein naphtha yield of the process is no more than about 6 wt %, and the density of diesel product is reduced by at least about 70 kg/m$^3$ at 15.6° C. compared with the density of the hydrocarbon feed.

22. The liquid-full process of claim 20, wherein diesel product cetane increase is at least about 11.

23. The liquid-full process of claim 19, wherein the first product effluent is contacted with the second catalyst without prior separation of ammonia, hydrogen sulfide, and remaining hydrogen from the first product effluent.

24. The liquid-full process of claim 19, wherein the first product effluent produced in step (b) has a nitrogen content no more than about 10 wppm.

25. The liquid-full process of claim 19, wherein the zeolite ring opening catalyst comprises nickel-tungsten (NiW) loaded on a zeolite support.

* * * * *